US011766578B1

(12) United States Patent
McNulty et al.

(10) Patent No.: US 11,766,578 B1
(45) Date of Patent: Sep. 26, 2023

(54) ACTIVE STAIRWELL COMPENSATION SYSTEMS AND METHODS

(71) Applicant: RM Manifold Group, Inc., Fort Worth, TX (US)

(72) Inventors: Timothy Edward McNulty, Southlake, TX (US); Jon Randall Hinson, Bethlehem, GA (US)

(73) Assignee: RM Manifold Group, Inc., Fort Worth, TX (US)

( * ) Notice: Subject to any disclaimer, the term of this patent is extended or adjusted under 35 U.S.C. 154(b) by 145 days.

(21) Appl. No.: 17/244,700

(22) Filed: Apr. 29, 2021

Related U.S. Application Data

(60) Provisional application No. 63/017,628, filed on Apr. 29, 2020.

(51) Int. Cl.
*A62C 2/12* (2006.01)
*F24F 13/10* (2006.01)
*A62C 2/24* (2006.01)

(52) U.S. Cl.
CPC ..... *A62C 2/12* (2013.01); *A62C 2/241* (2013.01); *F24F 13/10* (2013.01)

(58) Field of Classification Search
CPC ..... A62C 2/12; A62C 3/0214; F24F 13/10; F24F 11/33; F24F 11/34; F24F 2011/0004; E04F 11/02; E04F 17/04
See application file for complete search history.

(56) References Cited

U.S. PATENT DOCUMENTS

2020/0225833 A1* 7/2020 Naraharisetti ..... F24F 11/52

FOREIGN PATENT DOCUMENTS

KR 200316833 Y1 * 3/2003
KR 20050037819 A * 10/2003
KR 20140140760 A * 5/2013
KR 20170088537 A * 1/2016

OTHER PUBLICATIONS

A. Bhatia, Stairwell Pressurization Systems, Apr. 21, 2016, CED Engineering, M05-022 (Year: 2016).*

(Continued)

*Primary Examiner* — Edelmira Bosques
*Assistant Examiner* — Michael James Giordano
(74) *Attorney, Agent, or Firm* — AVEK IP, LLC

(57) ABSTRACT

An active stairwell compensation system includes air injection points at different elevations in a stairwell; a fan for providing airflow to the air injection points; sensors; air injection dampers; and a controller in data communication with the fan, the sensors, and the air injection dampers. At least some of the sensors are located inside the stairwell, and at least some of the sensors are located outside the stairwell. A respective air injection damper is located between each air injection point and the fan. The controller has programming to utilize data from the sensors to adjust an amount of air provided by the fan and independently adjust the air injection dampers to maintain a desirable amount of air pressure at the air injection points. The desirable amount of air pressure is selected to prevent smoke from entering the stairwell while allowing stairwell doors to open for egress.

16 Claims, 6 Drawing Sheets

(56) References Cited

OTHER PUBLICATIONS

Linquip Team, Pressure Transducer: Definition, Working Principle, and Types, Dec. 2, 2020, Linquip Technews, https://www.linquip.com/blog/pressure-transducer-types-and-definitions/#:~:text=Advantages%3A,and%20tiny%20size%20measurement%20instruments. (Year: 2020).*

Hickey, Lisa, Stairwell Pressurization for Smoke Control, Dec. 20, 2010, Belimo https://blog.belimo.com/blog/blog/bid/33484/stairwell-pressurization-for-smoke-control (Year: 2010).*

* cited by examiner

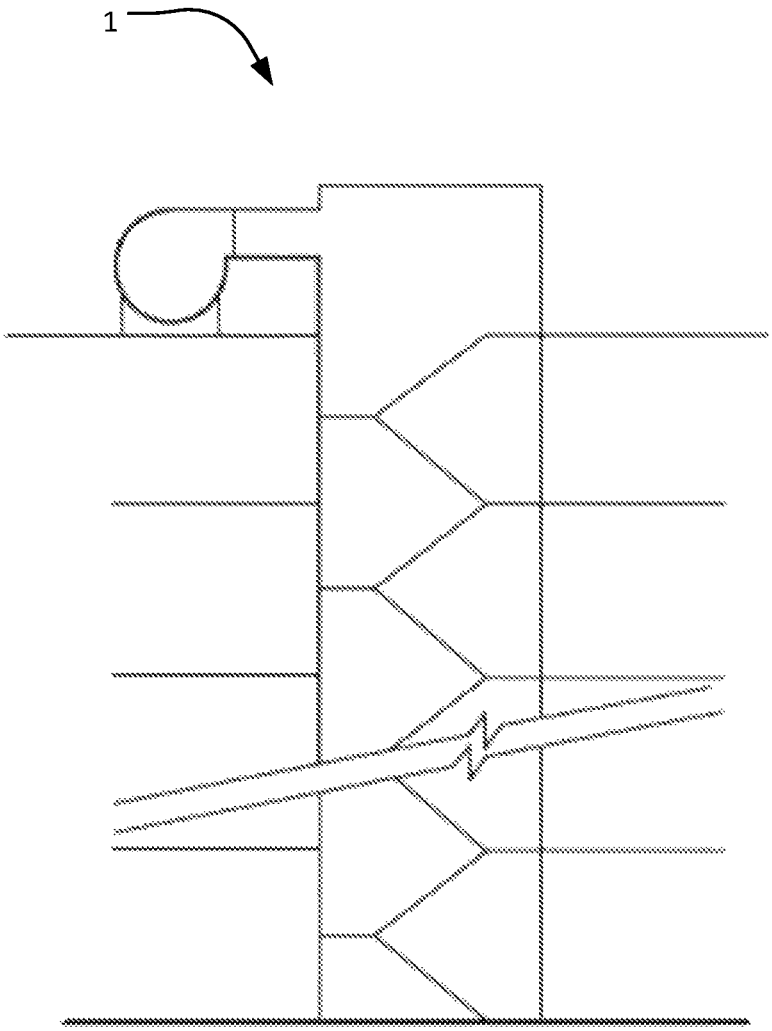
FIG. 1A – PRIOR ART

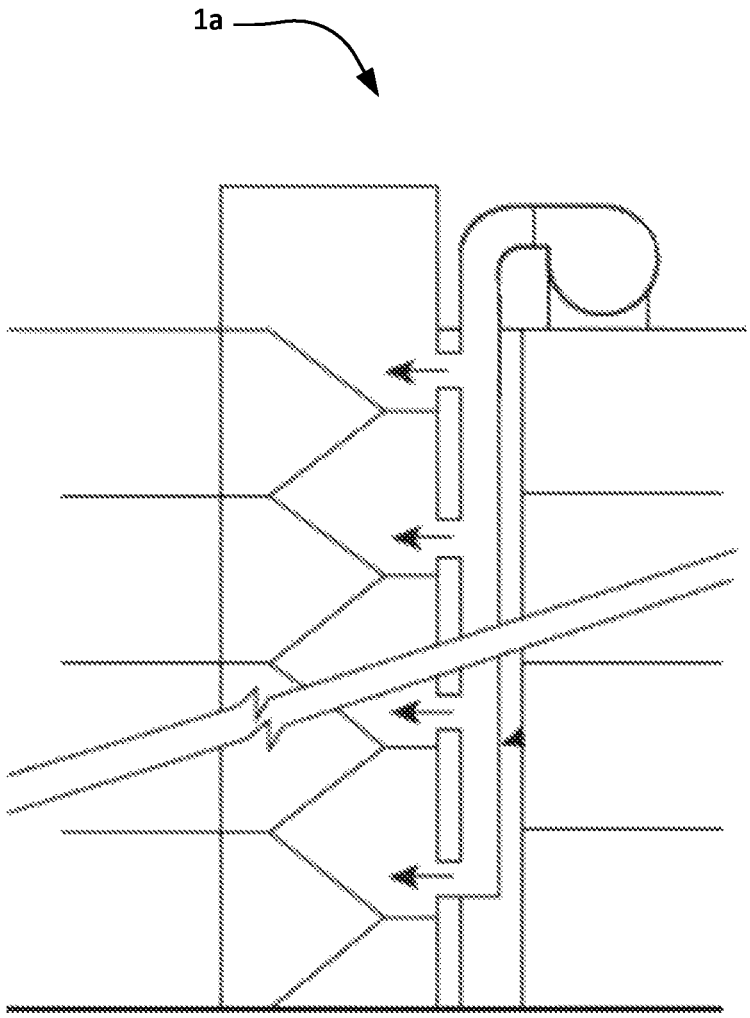
FIG. 1B – PRIOR ART

GRAPH 1

GRAPH 2

ACTIVE STAIRWELL COMPENSATION SYSTEMS AND METHODS

RELATED APPLICATIONS

This application claims priority to U.S. 63/017,628, filed Apr. 29, 2020, the contents of which are hereby incorporated by reference in their entirety.

FIELD OF THE DISCLOSURE

The disclosure relates generally to the field of stairwell pressurization systems. More specifically, the disclosure relates to stairwell compensation systems that actively compensate for building conditions.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

According to an embodiment, an active stairwell compensation system for use with a stairwell includes a fan; a plurality of sensors; first, second, and third air injection points along the stairwell; first, second, and third air injection dampers; and a controller in data communication with the fan, the plurality of sensors, the first air injection damper, the second air injection damper, and the third air injection damper. At least one of the sensors is located inside the stairwell for detecting at least one condition inside the stairwell, and at least one of the sensors is located outside the stairwell for detecting at least one condition outside the stairwell. The first air injection damper is located between the first air injection point and the fan to regulate an amount of air from the fan that is allowed to exit through the first air injection point. The second air injection damper is located between the second air injection point and the fan to regulate an amount of air from the fan that is allowed to exit through the second air injection point. The third air injection damper is located between the third air injection point and the fan to regulate an amount of air from the fan that is allowed to exit through the third air injection point. The controller has programming to utilize data from the plurality of sensors to adjust an amount of air provided by the fan and independently adjust the first, second, and third air injection dampers to maintain a desirable amount of air pressure at the first, second, and third air injection points. The desirable amount of air pressure is selected to prevent smoke from entering the stairwell while allowing stairwell doors to open for egress.

According to another embodiment, an active stairwell compensation system includes a plurality of air injection points at different elevations in a stairwell; a fan for providing airflow to the plurality of air injection points; a plurality of sensors; a plurality of air injection dampers; and a controller in data communication with the fan, the plurality of sensors, and the plurality of air injection dampers. At least some of the plurality of sensors are located inside the stairwell, and at least some of the plurality of sensors are located outside the stairwell. A respective air injection damper is located between each air injection point and the fan. The controller has programming to utilize data from the plurality of sensors to adjust an amount of air provided by the fan and independently adjust the air injection dampers to maintain a desirable amount of air pressure at the plurality of air injection points. The desirable amount of air pressure is selected to prevent smoke from entering the stairwell while allowing stairwell doors to open for egress.

According to yet another embodiment, a stairwell having an active stairwell compensation system is provided. The stairwell has a plurality of injection points at different elevations. The active stairwell compensation system includes a fan for providing airflow to the plurality of air injection points; a plurality of sensors; a plurality of air injection dampers positioned such that airflow between the fan and each air injection point must pass through a respective air injection damper; and a controller in data communication with the fan, the plurality of sensors, and the plurality of air injection dampers. At least some of the plurality of sensors are located inside the stairwell to determine at least one condition inside the stairwell, and at least some of the plurality of sensors are located outside the stairwell to determine at least one condition on a floor outside the stairwell. The controller has programming to utilize data from the plurality of sensors to adjust an amount of air provided by the fan and independently adjust the air injection dampers to maintain a desirable amount of air pressure at the plurality of air injection points. The desirable amount of air pressure is selected to prevent smoke from entering the stairwell while allowing stairwell doors to open for egress.

BRIEF DESCRIPTION OF THE DRAWINGS

FIG. 1A shows a PRIOR ART single-point injection system for stairwell pressurization.

FIG. 1B shows a PRIOR ART multiple-point injection system for stairwell pressurization.

DETAILED DESCRIPTION

Figure 2:
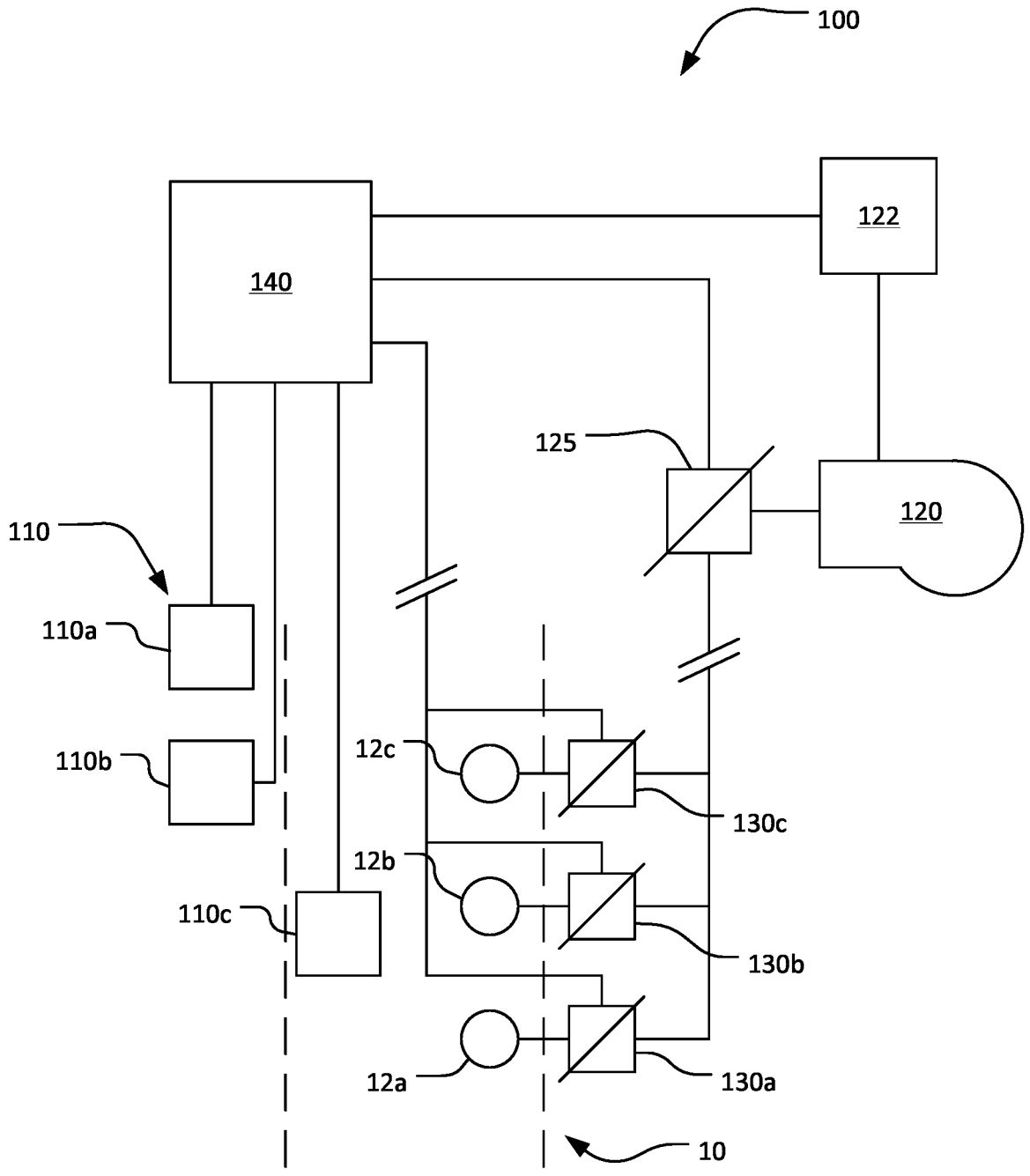
FIG. 2 shows a stairwell having an active stairwell compensation system, according to an embodiment of the current disclosure.

Smoke inhalation can be incredibly harmful to humans. As such, smoke control systems play an important role in protecting lives when a fire breaks out in a building. To mitigate the chance that a building's occupants are subjected to dangerous smoke inhalation, smoke control systems typically attempt to preclude smoke from migrating to exit paths through which the occupants evacuate the building. Exit paths for buildings having multiple floors or stories commonly include stairwells. Generally, a pressure differential is created between the stairwell and other parts of the building to prevent smoke from entering the stairwell. A stairwell that has a higher atmospheric pressure than adjacent areas is said to have a "positive" pressure differential, and this positive pressure will cause air to flow from the stairwell to the building floors. Because the air is flowing from the stairwell, any smoke that originates from outside the stairwell will be pushed back and prevented from entering the stairwell. Conversely, a stairwell that has a lower atmospheric pressure than adjacent areas is said to have a "negative" pressure differential, which will cause air to flow from the adjacent areas and into the stairwell. Smoke originating outside the stairwell may travel with the airflow into the stairwell, endangering occupants using the stairwell to evacuate.

Stairwell pressurization systems for creating a stairwell with a positive pressure differential are known in the art. FIGS. 1A and 1B show prior art stairwell pressurization systems: a single-point injection system 1 and a multiple-point injection system 1*a*. These conventional systems 1, 1*a* operate by injecting supply air into the stairwell, thus creating the desired positive pressure differential. However, such conventional systems suffer from multiple issues. For example, care must be taken to ensure that the stairwell pressure is not too great. An excessive positive stairwell pressure may make the stairwell doors that connect the stairwell to the building's floors difficult or even impossible to open. This may prove disastrous to occupants who must use those stairwell doors to evacuate the building.

Further, buildings may experience a phenomenon known as "stack effect" or "reverse stack effect," where a stairway may have an unequal distribution of pressure along the stairway height. The stack effect stems from the disparity between the indoor air temperature of the building and the outdoor air temperature, and is more pronounced the taller a building is. Compensating for the stack effect across the numerous floors of a building has proven to be a challenge to manage with conventional stairway pressurization systems. One workaround for especially tall buildings is to compartmentalize, or divide, the stairway into zones that are independent of each other and their respective pressures. However, if the stairwell doorways are opened between two or more of these zones (as would typically occur during an evacuation), the zones are effectively "short circuited" atmospherically, thus rendering the compartmentalization moot.

Figure 5:
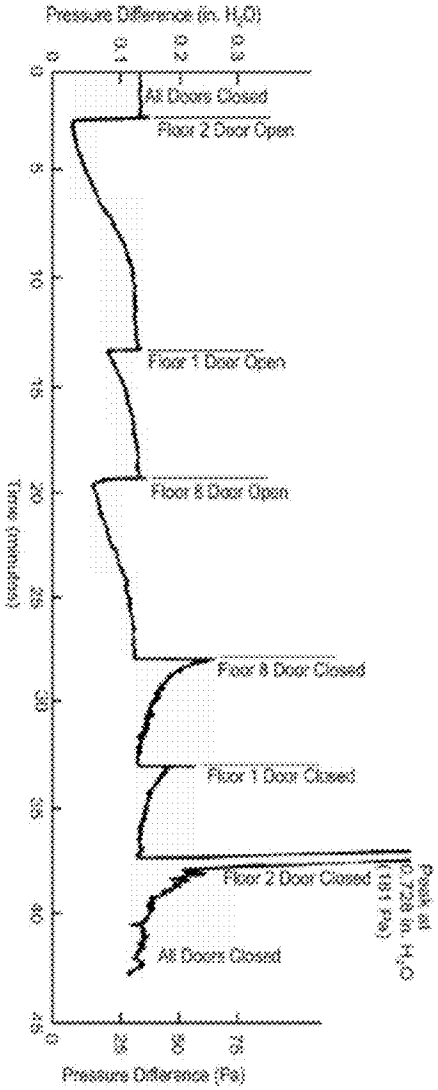
FIG. 5 is Graph 1, taken from the ASHRAE Handbook of Smoke Control Engineering at FIG. 10.12.
Figure 6:
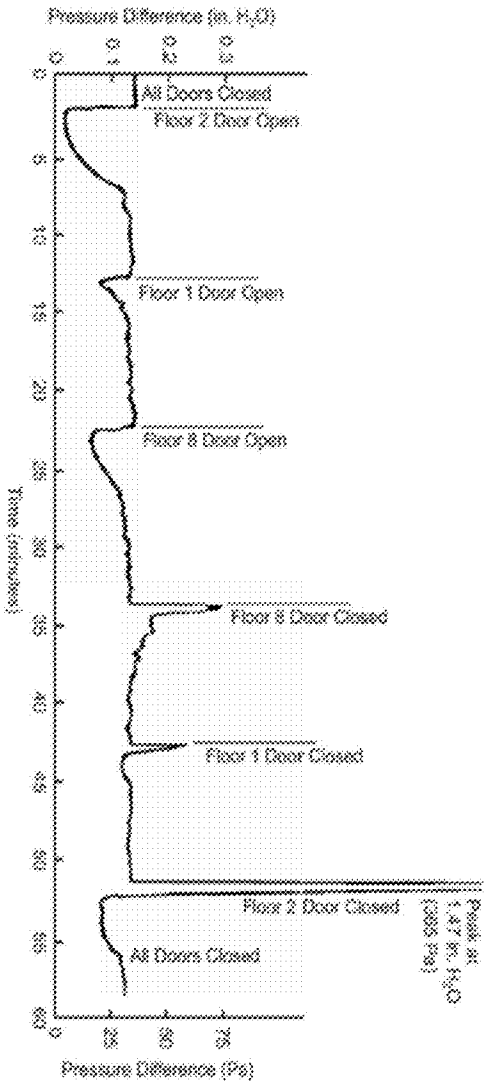
FIG. 6 is Graph 2, taken from the ASHRAE Handbook of Smoke Control Engineering at FIG. 10.13.

Another issue with conventional stairwell systems is that they typically react slowly, if at all, to changes in stairwell pressure. Conventional systems may use methods such as variable-air-volume or bypass-damper methods to change the amount of air being injected into the stairwell to compensate for changes in stairwell pressure. However, these methods take a significant amount of time (e.g., thirty or more seconds) to bring the stairwell pressure to a desired level after a pressure change. Graphs 1 and 2 in FIGS. 5 and 6, taken from the ASHRAE Handbook of Smoke Control Engineering at FIGS. 10.12 and 10.13, show pressure measured from conventional variable-air-volume and bypass damper systems as various building doors are opened. The opening and closing of stairwell doors, and the associated pressure changes resulting therefrom, is an especially relevant concern as the occupants will open and close stairwell doors as they evacuate the building. Opening a doorway between the stairwell and a building floor causes the pressure in the stairwell to equalize with the pressure of that floor. Generally, this means that air will flow out of the stairwell through the doorway and into the floor, causing the overall stairwell pressure to drop. This pressure drop may reduce or eliminate the positive pressure differential required to preclude smoke from entering the stairwell. Similarly, closing stairwell doors changes the overall stairway pressure; closing a stairwell door will prevent air from flowing out into the building floor, causing a spike in overall stairwell pressure. This spike in pressure may result in one or more of the stairwell doors being harder or impossible to open for a significant period of time, which may prove disastrous in an emergency where the occupants need to quickly evacuate the building.

Yet another pressure-change concern stems from the fire itself. Due to the heat created by the fire, the floor where the fire is located (sometimes referred to herein as the "fire floor") may experience a localized spike in pressure. This spike in pressure may overcome the stairwell pressure and allow smoke to infiltrate the stairwell. The smoke may have ample time to infiltrate the stairwell from the fire floor, as the conventional stairway pressurization systems slowly work to compensate for the fire. Further, conventional stairway pressurization systems that attempt to increase the overall stairway pressure may inadvertently create too much pressure at the doorways to other floors of the building, making them too difficult to open.

Still another issue with conventional systems, such as the single point injection system of FIG. 1A, is that the stairwell pressure at the air injection point (i.e., where the system inputs air into the stairwell) may differ significantly from localized pressures at other heights of the stairwell that are further from the air injection point. For example, a building with a top floor having a conventional single point injection system may have a top floor that is influenced more greatly by the pressure provided by the injection system than a bottom or ground floor of the same building. Embodiments of the active stairwell compensation system described herein may improve upon the prior art.

FIG. 2 illustrates a stairwell 10 having an active stairwell compensation system (or "ASCS") according to an embodiment 100 of the current disclosure. The stairwell 10 has injection points 12 (e.g., injection points 12*a*, 12*b*, 12*c*), and any number of injection points 12 may be included. It may be particularly desirable to have at least one injection point 12 for each floor of a building. The active stairwell compensation system 100 includes sensors 110 (e.g., sensors 110*a*, 110*b*, 110*c*), a fan 120, a variable frequency drive 122 for actuating the fan 120, air injection dampers 130 (e.g., air injection dampers 130*a*, 130*b*, 130*c*), and a system controller 140 in data communication with the sensors 110, the variable frequency drive 122, and the air injection dampers 130.

The sensors 110 may include, for example, pressure transducers, temperature sensors, and smoke sensors. Pressure transducers may be used to monitor pressure at various points along the stairwell 10, and it may be useful for pressure transducers to be located both inside and outside of the stairwell 10 (and even outside the building) such that internal and external pressures may be compared. Temperature sensors may be placed inside and/or outside the stairwell 10 at various locations and may be used, for example, to confirm or predict data from the pressure transducers. Smoke sensors may similarly be placed inside and/or outside the stairwell 10 at various locations and may also be used, for example, to confirm or predict data from the pressure transducers. It may be particularly useful for a smoke sensor to monitor an air intake of the fan 120 to prevent the fan 120 from circulating smoky air into the stairwell 10. In some embodiments, such a smoke sensor 110 may be in direct communication with the fan 120 or a damper to the air intake so that the fan 120 can stop running or the air intake can be closed without the need to receive such a command from the controller 140.

The fan 120 may be a centrifugal fan, an axial fan, a propeller fan, or any other appropriate type of fan, whether now know or later developed. And while FIG. 2 shows the fan 120 and the variable frequency drive 122 being separate, the two may be combined in a single unit. Moreover, instead of (or in addition to) changing a speed of the fan 120, multiple fans 120 may be included such that one or more of the fans 120 may be turned on or off to adjust airflow and/or a primary (or "relief") damper 125 may regulate an amount of air introduced into the system by the fan 120 (e.g., by providing a bypass or directing an amount of air from the fan 120 to atmosphere or another location apart from the stairwell).

The air injection dampers 130 are located between the supply fan 120 and the airflow injection points 12. It may be particularly desirable to have a respective air injection damper 130 between each injection point 12 and the fan 120 (such that the number of air injection dampers 130 is equal to the number of injection points 12), though some embodiments may utilize a respective air injection damper 130 to allow or restrict airflow to multiple injection points 12.

The air injection dampers 130 may allow the ASCS to control airflow, and thus pressure, in each of multiple zones (e.g., a portion of the stairwell that includes one or more building stories) that make up the stairwell 10. For example, a stairwell 10 may include three zones that are fed from a single supply fan 120, with each of the zones having an airflow injection point 12. Each of these three injection points 12 may have a separate air flow damper 130 for selectively modulating the airflow entering that zone. As such, and as described in additional detail below, the ASCS may respond to and compensate for pressure changes that are detected in each zone.

It may be particularly desirable for the air injection dampers 130 to be capable of responding relatively quickly (e.g., in about two seconds or less) to commands from the controller 140 to allow the ASCS 100 to quickly respond to changes in stairwell pressure. Opposed blade dampers may be particularly desirable for use as the air injection dampers 130, though other types of dampers may alternately be used. Because the air injection dampers 130 may allow the ASCS 100 to respond to pressure changes so quickly and in a targeted manner, the ASCS 100 may correct the stairwell pressure significantly faster than conventional compensation systems such as variable-air-volume systems and bypass damper systems. And any time savings may be critical due to the urgent nature of a building fire. For example, a stairwell door being unable to be opened for even thirty seconds (or less) due to stairwell pressure changes may be fatal to occupants attempting to evacuate during a building fire. Further, quicker pressure compensation may mitigate an amount of smoke which moves into the stairwell during any period which a portion of the stairwell experiences a negative pressure (such as when a door opens).

Figure 3:
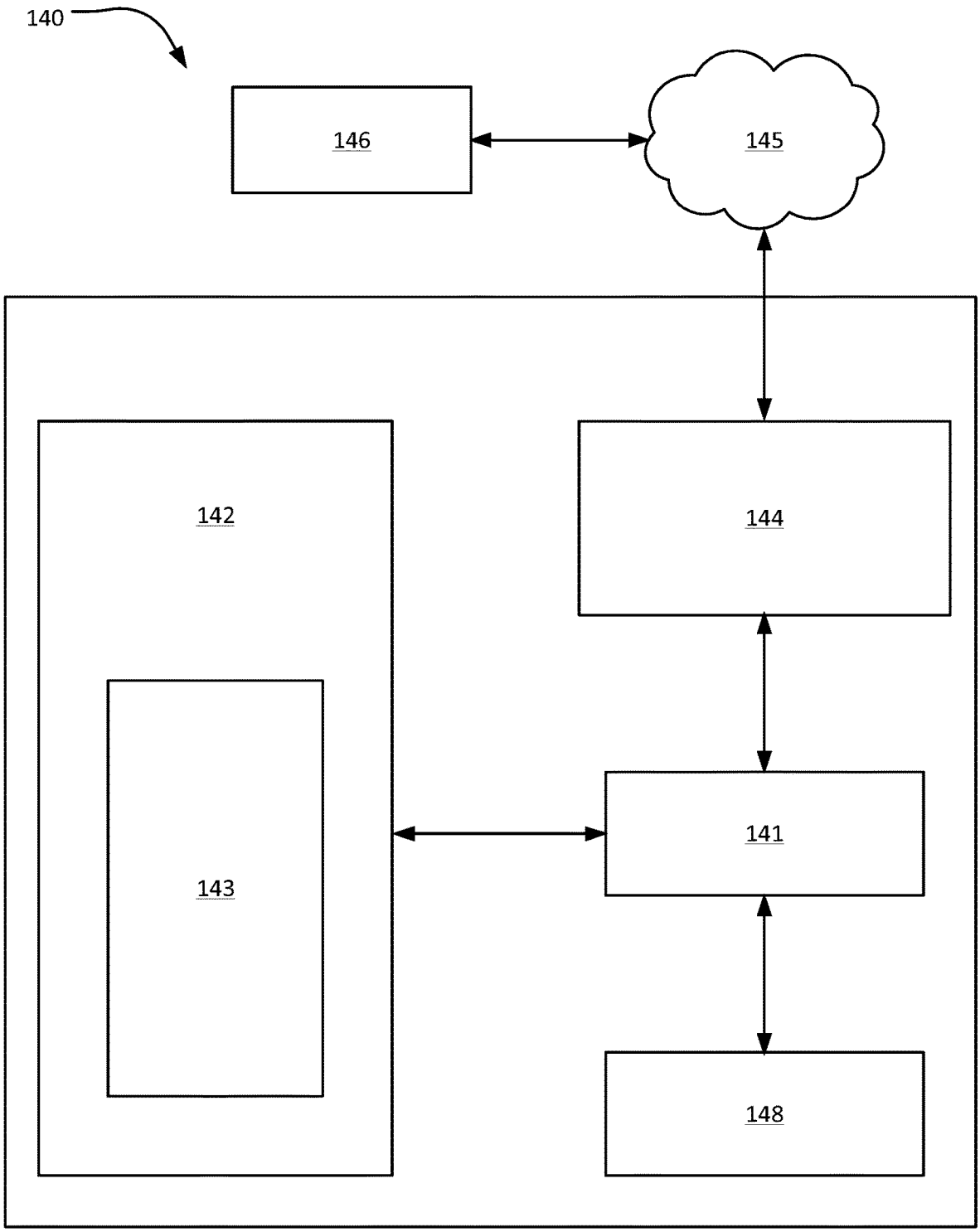
FIG. 3 shows a controller of the active stairwell compensation system of FIG. 2.

The controller 140 may include a point logic controller communicatively linked (e.g., wired and/or wirelessly) to a firefighter smoke control station (FSCS) of the building, and which may be controlled therefrom. Alternately or additionally, the controller 140 may include another local or distributed computing system that may determine ASCS operation as shown in FIG. 3. The computing system may be, for example, a smartphone, a laptop computer, a desktop computer, a flexible circuit board, or other computing device whether now known or subsequently developed. The computing system may include a processor 141, memory 142, a communication module 144, and a dataport 148. These components may be communicatively coupled together by an interconnect bus.

The processor 141 may include any processor used in smartphones and/or other computing devices, including an analog processor (e.g., a Nano carbon-based processor). The processor 141 may be electronic circuitry located on a common chip or circuit board, or may be a distributed processor such that one portion of the processor is physically separate from another portion of the processor. In other words, discrete processing devices (e.g., one or more microprocessors, one or more supplementary co-processors, one or more math co-processors, etc.) may be linked together (e.g., over a network) and collectively form the processor 141. While this document shall often refer to elements in the singular, those skilled in the art will appreciate that multiple such elements may often be employed and that the use of multiple such elements which collectively perform as expressly or inherently disclosed is fully contemplated herein.

The memory 142 may include volatile and non-volatile memory, and any appropriate data storage devices whether now existing or later developed may be used. Further, the memory 142 may be a unitary memory in one location, or may alternately be a distributed computer memory such that one portion of the computer memory is physically separate from another portion of the non-transitory computer memory. More particularly, the memory 142 may include both operating memory, such as random access memory (RAM), as well as data storage, such as read-only memory (ROM), hard drives, optical, flash memory, or any other suitable memory/storage element. The memory may include removable memory elements, such as a CompactFlash card, a MultiMediaCard (MMC), and/or a Secure Digital (SD) card. In certain embodiments, the memory includes a combination of magnetic, optical, and/or semiconductor memory, and may include, for example, RAM, ROM, flash drive, and/or a hard disk or drive. The memory 142 is in communication with the processor 141 for providing data to and receiving data from the processor 141. In some embodiments, data may be encrypted to prevent disassembly and reverse engineering. The processor 141 and the memory 142 may each be located entirely within a single device, or may be connected to each other by a communication medium, such as a USB port, a serial port cable, a coaxial cable, an Ethernet-type cable, a telephone line, a radio frequency transceiver, or other similar wireless or wired medium or combination of the foregoing. For example, the processor may be connected to the memory via the communications module 144 or the dataport 148.

The memory 142 may store instructions for communicating with other systems and may store, for example, a program (e.g., computer program code) adapted to direct the processor 141 in accordance with the embodiments described herein. The instructions also may include program elements, such as an operating system. While execution of sequences of instructions in the program causes the processor 141 to perform the process steps described herein, hard-wired circuitry may be used in place of, or in combination with, software/firmware instructions for implementation of the processes of the present embodiments. Thus, unless expressly noted, the present embodiments are not limited to any specific combination of hardware and software.

The memory 142 of ASCS 100 includes software 143 which contains machine-readable instructions (e.g., a software application as described above) configured to be executed by the processor 141. The software 143 may, for example, process user inputs to the controller 140 (e.g., stairwell pressure parameters, et cetera). The software 143 may cause the controller 140 to dynamically respond to a signal from the transducers and/or other sensors 110, such as by directing the primary damper 125 and/or the air injection dampers 130 to modify the airflow delivered to the stairwell 10 from the supply fan 120. In some embodiments, the controller 140 may implement (e.g., download, install, execute, etc.) the software 143, and in this manner be configured to enact the functions of the ASCS 100 disclosed herein. In other words, the controller 140 may be configured, retrofitted, and/or reconfigured with the software 143 for use with the ASCS 100.

The communication module 144 may be configured to handle communication links between the processor 141 and other external devices or receivers and to route incoming/outgoing data appropriately. In some embodiments, inbound data from the dataport 148 may be routed through the communication module before being directed to the processor 141, and outbound data from the processor 141 may be routed through the communication module 144 before being directed to the dataport 148. The communication module may include one or more transceiver modules configured for transmitting and receiving data, and using, for example, one or more protocols and/or technologies, such as Bluetooth, GSM, UMTS (3GSM), IS-95 (CDMA one), IS-00 (CDMA 00), LTE, FDMA, TDMA, W-CDMA, CDMA, OFDMA, Wi-Fi, WiMAX, or any other appropriate protocol and/or technology.

The dataport 148 may be any type of connector used for physically interfacing with a smartphone, computer, and/or other devices, such as a mini-USB/USB port, an IPHONE®/IPOD®-pin connector, and/or LIGHTNING® connector. In other embodiments, the dataport may include multiple communication channels for simultaneous communication with, for example, other processors, servers, and/or client terminals.

As shown in FIG. 3, the processor 141 may be in data communication with a remote storage 146 over network 145. The network 145 may be a wired network, a wireless network, or comprise elements of both. The remote storage 146 may be, for example, the "cloud" or other remote storage in communication with other computing systems. In some embodiments, data (e.g., building data, building pressure parameters, etc.) may be stored in the remote storage 146 such that the remote storage 146 forms part of the memory 142.

Figure 4:
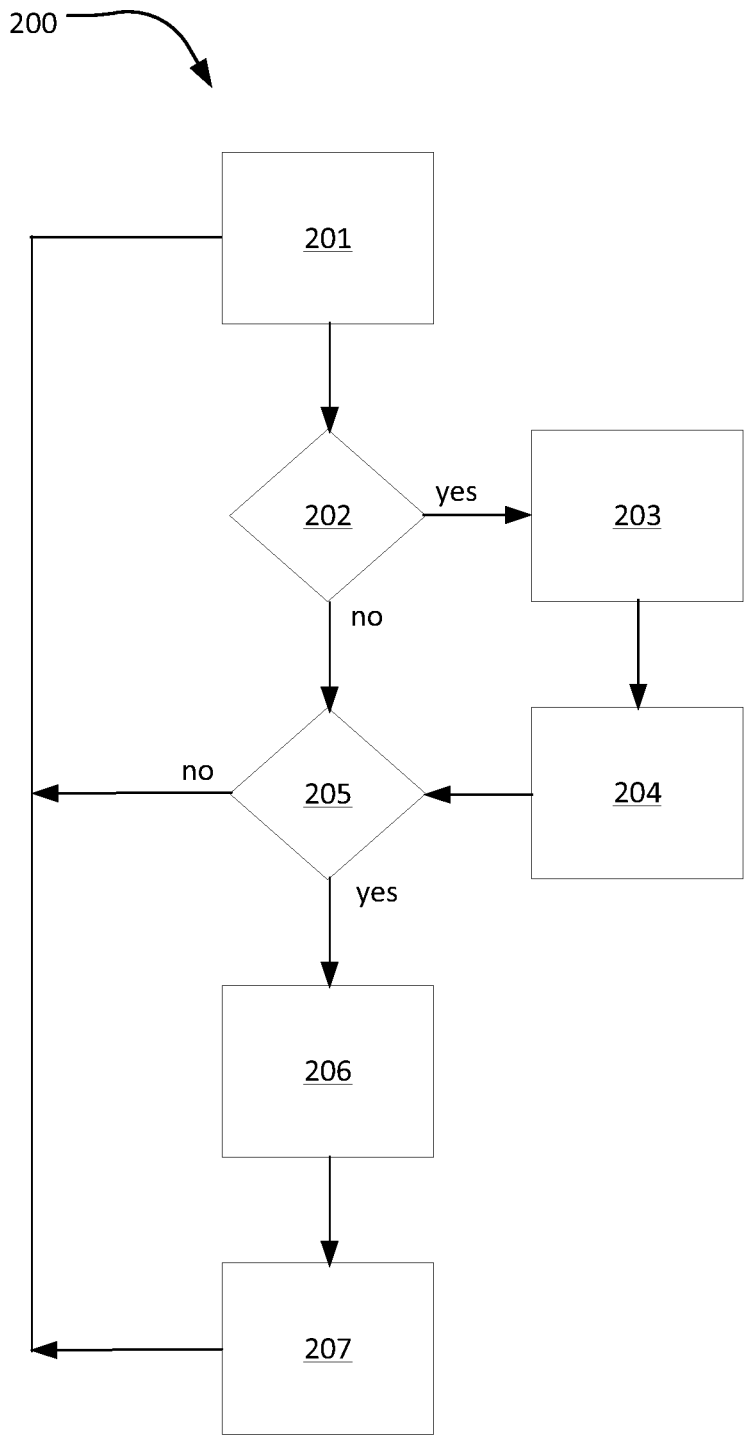
FIG. 4 is a flowchart illustrating various steps performed by the active stairwell compensation system of FIG. 2.

In use, the ASCS 100 may be installed into a building stairwell 10 and may control the pressure thereof. The ASCS 100 may sense the pressure within the stairwell 10 and may work to maintain the stairwell 10 at a sufficient positive pressure (i.e., a pressure where smoke infiltration into the stairwell 10 is mitigated and the stairwell doors may still be opened by a building occupant). FIG. 4 illustrates a method 200 that may be employed by the various active stairwell compensation systems described herein to maintain stairwell pressure.

At step 201, the sensors 110 (e.g., the transducers) obtain data from various points along and outside the stairwell 10. For example, the transducers 110 may monitor the various floors in a multistory building, with some of the transducers 110 being located inside the stairwell 10 and others of the transducers 110 being located outside the stairwell 10. Many of the transducers 110 are associated with respective injection points 12, though multiple sensors 110 may be associated with the same injection point 12. For example, a transducer 110 inside the stairwell 10 and a transducer 110 outside the stairwell 10 may be located on opposite sides of a door to the stairwell 10, and both of those transducers 110 may be associated with a single injection point 12 (with other transducers 110 being associated with different injection points 12 and one or more transducer 110 being associated with outdoor ambient pressure). Each transducer 110 may gather local data (e.g., pressure data) and send the gathered data to the controller 140.

At step 202, the controller 140 (using the software 143 and the data from the sensors 110) determines whether pressure needs to be increased or decreased at each injection point 12. For example, the controller 140 may compare data from one or more transducer 110 associated with a given injection point 12 with a desired range of pressure values, and/or may identify trends based on data from other transducers 110. For example, if a stairwell door is opened on a sixth floor of a building, the controller 140 may identify the pressure drop on the sixth floor of the stairwell 10 using data from the transducers 110 associated with the injection point 12 on the sixth floor of the stairwell 10, and then identify sequential pressure drops on the fifth and fourth floors in a similar manner and proactively project what the pressure drop will be on the third floor, and when such pressure drop will occur. As another example of preemptive adjustment, a transducer 110 on a floor outside the stairwell 10 may detect a pressure increase which may indicate a fire on that floor. The controller 140 may then determine that additional pressure is needed to keep smoke from the floor from entering the stairwell 10 in case the stairwell door associated with the floor is opened by evacuating occupants.

If the controller 140 determines that a pressure needs to be adjusted, the method moves to step 203 where the controller 140 determines whether to adjust the speed of the fan 122, the primary damper 125, and/or one or more of the air injection dampers 130 (more open or more closed). The controller 140 then causes such adjustment(s) at step 204 to introduce additional air into any air injection points 12 that need additional air and to restrict air from entering any air injection points 12 that do not need additional air, and the method 200 proceeds to step 205. In the example above where a stairwell door is opened on the sixth floor, air may be introduced into the air injection points 12 on the sixth, fifth, and fourth floors, though with more air being introduced on the sixth floor than on the fifth and fourth floors through adjustment of the respective air injection dampers 130. If the controller 140 determined that no adjustment was necessary at step 202, the method 200 proceeds directly to step 205.

At step 205, the controller 140 (using the software 143 and the data from the smoke sensor 110 monitoring the air intake of the fan 120) determines whether the air intake is compromised with smoke such that the fan 120 cannot safely introduce air from the air intake into the stairway 10.

If the controller 140 determines that the air intake is compromised, the method moves to step 206, where the controller determines whether to adjust the speed of the fan 122, the primary damper 125, and/or one or more of the air injection dampers 130. For example, the controller may determine that the fan 120 should be slowed or stopped, that the primary damper 125 should restrict some or all of the air from the fan 120 from entering the stairwell 10, and that the air injection dampers 130 should restrict air from entering the stairwell 10 through the air injection points 12. In some embodiments, the controller 140 may cause all of those actions at once (e.g., stop the fan 120, use the primary damper 125 to restrict air from the fan 120 from entering the stairwell 10, and use the air injection dampers 130 to restrict air from the fan 120 from entering the stairwell 10). In other embodiments, based upon such things as how often the air intake is sampled for smoke and the distance of respective air injection dampers 130 from the fan 120, the controller 140 may take a staged approach. For example, air injection dampers 130 closest to the fan 120 may be closed first, and air injection dampers 130 further from the fan 120 may be closed in a sequential or other measured basis. This may allow clean air already in the system to be introduced into the stairwell 10 while preventing the compromised air from reaching the stairwell 10. The controller 140 then causes such adjustment(s) at step 207, and the method returns to step 201. If the controller 140 determined that the intake air is not compromised at step 205, the method 200 returns directly to step 201.

In some embodiments, the method may cycle through steps 201 through 207 as shown in FIG. 4. In other embodiments, the method may loop certain portions of the process (e.g., by making the determination at step 202 more or less frequently than the determination at step 205) or may simultaneously perform various steps (e.g., by making the determination at step 202 simultaneously with the determination at step 205, or by performing step 203 and/or step 204 simultaneously with step 205). As such, the exact order of steps is not critical to the method 200, though data must be obtained before determinations can be made. And, as described above, the controller 140 may be a distributed controller having various sub-components that collectively act as described.

If desired, multiple active compensation systems 100 may be implemented in a single stairwell 10, such as for stairwells 10 that span a large number of stories. If multiple active stairwell compensation systems 100 are used, each may be used in a respective zone with a single air injection point 12 or with multiple air injection points 12. For example, a stairwell 10 may include three zones that are fed from a three different supply fans 120, with each of the zones having airflow injection points 12 supplied by one of the three fans 120. Each of the stairwell zones may have a zone controller which may be communicatively (e.g., wired and/or wirelessly) coupled to form the controller 140. Each zone may be controlled as discussed above regarding method 200, though data and airflow in one zone may additionally be used to affect other (e.g., adjacent) zones.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the claims.

The invention of claimed is:

1. An active stairwell compensation system for use with a stairwell, the active stairwell compensation system comprising:

a fan;

a plurality of sensors, at least one said sensor being located inside the stairwell for detecting at least one condition inside the stairwell, at least one said sensor being located outside the stairwell for detecting at least one condition outside the stairwell;

first, second, third, fourth, fifth, and sixth air injection points along the stairwell;

first, second, and third air injection dampers, the first air injection damper being located between the first air injection point and the fan to regulate an amount of air from the fan that is allowed to exit through the first air injection point, the second air injection damper being located between the second air injection point and the fan to regulate an amount of air from the fan that is allowed to exit through the second air injection point, the third air injection damper being located between the third air injection point and the fan to regulate an amount of air from the fan that is allowed to exit through the third air injection point; and a controller in data communication with the fan, the plurality of sensors, the first air injection damper, the second air injection damper, and the third air injection damper; the controller having programming to utilize data from the plurality of sensors to adjust an amount of air provided by the fan and independently adjust the first, second, and third air injection dampers to maintain a desirable amount of air pressure at the first, second, and third air injection points; the desirable amount of air pressure being selected to prevent smoke from entering the stairwell while allowing stairwell doors to open for egress;

wherein the fourth air injection point is between the first and second air injection points;

wherein the fifth air injection point is between the second and third air injection points;

wherein the first air injection damper is located between the fourth air injection point and the fan, such that the first air injection damper is positioned to regulate an amount of air from the fan that is allowed to exit through both the first and fourth air injection points;

wherein the second air injection damper is located between the fifth air injection point and the fan, such that the second air injection damper is positioned to regulate an amount of air from the fan that is allowed to exit through both the second and fifth air injection points; and wherein the third air injection damper is located between the sixth air injection point and the fan, such that the third air injection damper is positioned to regulate an amount of air from the fan that is allowed to exit through both the third and sixth air injection points.

2. The active stairwell compensation system of claim 1, wherein the desirable amount of air pressure is a range of air pressure.

3. The active stairwell compensation system of claim 1, wherein the controller is a distributed controller.

4. The active stairwell compensation system of claim 1, wherein the plurality of sensors includes a plurality of pressure transducers.

5. The active stairwell compensation system of claim 1, wherein the at least one condition includes at least one item selected from the group consisting of pressure, heat, and smoke.

6. The active stairwell compensation system of claim 1, wherein the controller has programming to preemptively adjust an amount of pressure in the stairwell based on data from the plurality of sensors by causing a change in state of at least one item selected from the group consisting of the fan, the first air injection damper, the second air injection damper, and the third air injection damper.

7. The active stairwell compensation system of claim 1, further comprising:

a primary damper in data communication with the controller; and a variable frequency drive in data communication with the controller; and wherein the controller has programming to:

actuate the primary damper to regulate an amount of air introduced into the system by the fan; and control the variable frequency drive to adjust a speed of the fan.

8. The active stairwell compensation system of claim 1, wherein the first, second, and third air injection dampers are each opposed blade dampers having an adjustment response time of two seconds or less.

9. An active stairwell compensation system, comprising:

a plurality of air injection points at different elevations in a stairwell;

a fan for providing airflow to the plurality of air injection points;

a plurality of sensors, at least some of the plurality of sensors being located inside the stairwell, at least some of the plurality of sensors being located outside the stairwell;

a plurality of air injection dampers, a respective said air injection damper being located between each said air injection point and the fan;

a controller in data communication with the fan, the plurality of sensors, and the plurality of air injection dampers; the controller having programming to utilize data from the plurality of sensors to adjust an amount of air provided by the fan and independently adjust said air injection dampers to maintain a desirable amount of air pressure at the plurality of air injection points; the desirable amount of air pressure being selected to prevent smoke from entering the stairwell while allowing stairwell doors to open for egress;

a primary damper in data communication with the controller; and a variable frequency drive in data communication with the controller;

wherein the controller has programming to:

actuate the primary damper to regulate an amount of air introduced into the system by the fan; and control the variable frequency drive to adjust a speed of the fan;

wherein at least one of the sensors is a smoke sensor monitoring an air intake of the fan; and wherein the controller has programming to determine whether the air intake is compromised with smoke using data from the smoke sensor, and if compromised with smoke, cause all of: (a) stopping the fan, (b) actuating the primary damper to stop air from being introduced into the system by the fan, and (c) adjusting each said air injection damper to prevent airflow into the stairwell.

10. The active stairwell compensation system of claim 9, wherein at least some of the air injection dampers are located between two said air injection points and the fan to simultaneously regulate airflow through two said air injection points.

11. The active stairwell compensation system of claim 10, wherein the controller has programming to preemptively adjust an amount of pressure in the stairwell based on data from the plurality of sensors by causing a change in state of at least one item selected from the group consisting of the fan, the primary damper, and at least one said air injection damper.

12. The active stairwell compensation system of claim 9, wherein each said air injection damper is an opposed blade damper having an adjustment response time of two seconds or less.

13. The active stairwell compensation system of claim 9, wherein the controller is a distributed controller.

14. The active stairwell compensation system of claim 9, wherein the controller has programming to preemptively adjust an amount of pressure in the stairwell based on data from the plurality of sensors by causing a change in state of at least one item selected from the group consisting of the fan, the primary damper, and at least one said air injection damper.

15. A stairwell having the active stairwell compensation system of claim 9.

16. A stairwell having the active stairwell compensation system of claim 1.

* * * * *